US007757333B2

(12) United States Patent
Battaglia

(10) Patent No.: US 7,757,333 B2
(45) Date of Patent: Jul. 20, 2010

(54) TOOTHBRUSH

(75) Inventor: Massimo Battaglia, Novara (IT)

(73) Assignee: GlaxoSmithKline Consumer Healthcare GmbH & Co. KG, Buehl (Baden) (DE)

( * ) Notice: Subject to any disclaimer, the term of this patent is extended or adjusted under 35 U.S.C. 154(b) by 0 days.

(21) Appl. No.: 11/571,839

(22) PCT Filed: Jun. 13, 2005

(86) PCT No.: PCT/EP2005/007720

§ 371 (c)(1),
(2), (4) Date: Dec. 3, 2007

(87) PCT Pub. No.: WO2006/005624

PCT Pub. Date: Jan. 19, 2006

(65) Prior Publication Data

US 2008/0115305 A1 May 22, 2008

(30) Foreign Application Priority Data

Jul. 15, 2004 (GB) ..... 0415871.3

(51) Int. Cl.
*A46B 7/02* (2006.01)
*A46B 9/04* (2006.01)

(52) U.S. Cl. ..... 15/167.1; 15/201; D4/104; D4/105

(58) Field of Classification Search ..... 15/167.1, 15/167.2, 172, 201; D4/104, 105
See application file for complete search history.

(56) References Cited

U.S. PATENT DOCUMENTS

| | | | | |
|---|---|---|---|---|
| 2,796,620 | A * | 6/1957 | Bressler | 15/201 |
| 3,253,292 | A * | 5/1966 | Herschensohn | 15/201 |
| 4,472,853 | A | 9/1984 | Rauch et al. | |
| 4,776,054 | A * | 10/1988 | Rauch | 15/167.1 |
| 6,178,582 | B1 * | 1/2001 | Halm | 15/167.1 |
| 6,219,874 | B1 * | 4/2001 | van Gelder et al. | 15/167.1 |
| 6,327,735 | B1 | 12/2001 | Kraemer | |
| 6,817,054 | B2 * | 11/2004 | Moskovich et al. | 15/167.1 |
| 2003/0084533 | A1 | 5/2003 | Gelder et al. | |

FOREIGN PATENT DOCUMENTS

| | | |
|---|---|---|
| WO | WO00/74522 | 12/2000 |
| WO | WO03/030680 | 4/2003 |
| WO | WO2004/041023 | 5/2004 |

* cited by examiner

*Primary Examiner*—Mark Spisich
(74) *Attorney, Agent, or Firm*—Nora Stein-Fernandez; Theodore R. Furman

(57) ABSTRACT

A toothbrush head comprising a mid section, a tip section resiliently flexibly connected to the tip end of the mid section, and at least two side sections each resiliently flexibly connected to the mid- or tip- section at respective points on widthways opposite sides of the mid- or tip- section.

11 Claims, 3 Drawing Sheets

TOOTHBRUSH

Figure 1:
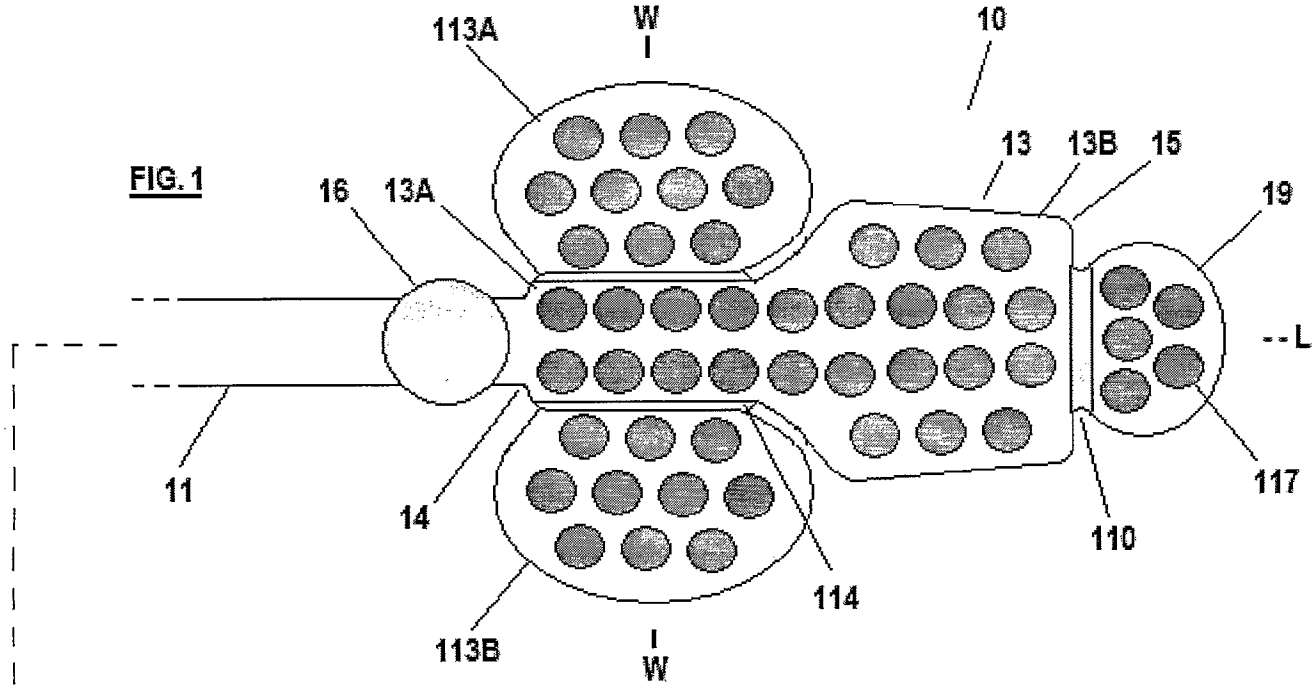

This application is a §371 nation phase entry of International Application No. PCT/EP05/07720, filed Jun. 13, 2005.

This invention relates to toothbrushes, in particular to toothbrushes having their head divided into flexibly linked sections.

Toothbrushes are well known articles, generally comprising a head carrying oral hygiene means such as bristles and a grip handle, the grip handle and head being disposed along a toothbrush longitudinal direction, with a perpendicular width direction. Typically oral hygiene means such as bristles, elastomer massage fingers or lamellae etc. extend from a surface termed herein the "bristle surface" of the head in a direction transverse to, typically perpendicular, to the longitudinal and width directions, this direction being termed herein the "bristle direction".

It is known to divide the toothbrush head into flexibly linked sections, for example as in WO-A-97/07707, U.S. Pat. No. 1,323,042, EP-A-1 300 096, U.S. Pat. No. 4,472,853 among many others.

It is an object of this invention to provide an improved toothbrush of this type, for example having an improved ability to access the surfaces of the teeth.

According to this invention a toothbrush head is provided, connected to or connectable to a toothbrush grip handle to define a toothbrush longitudinal head-handle direction, the toothbrush head comprising:

a mid section having a base end longitudinally close to the grip handle and a longitudinally opposite tip end longitudinally further from the grip handle, a tip section resiliently flexibly connected to the mid section at the tip end thereof, at least two side sections each resiliently flexibly connected to the mid- or tip-section at respective points on widthways opposite sides of the mid- or tip-section.

The mid section may be resiliently flexibly connected to the grip handle.

Preferably there are only two side sections, both of these connected to the mid section.

The tip section may be resiliently flexibly connected to the mid section to allow the tip section to fold relative to the mid section about a widthways oriented fold axis.

The side sections may be resiliently flexibly connected to the mid section to allow the side sections to fold relative to the mid section about a fold axis which is parallel to the longitudinal direction or which has a component oriented parallel to the longitudinal direction, e.g. a fold axis aligned at 0-30° to the longitudinal direction.

Preferably the bristle surface of the tip section forms an angle less than 180°, typically 150-175°, with the bristle surface of the mid section, as seen looking widthways.

Preferably the bristle surface of each of the side sections form an angle less than 180°, typically 150-175°, with the bristle surface of the mid section, as seen looking longitudinally.

Suitably the mid section extends for 50-80% of the length of the head as between the base end and the end of the tip section most longitudinally distant from the grip handle.

Suitably the side sections are located predominantly toward the base end of the mid section. Suitably the side sections each extend for 30-80% of the length of the mid section as between the base end and the end of the mid section most longitudinally distant from the grip handle. Suitably the mid section may comprise a widthways narrowed region adjacent its base end and the side sections may be connected to this narrowed region. At this part of the head the relative widthways dimensions of the side section: narrowed region may be in the range 2:1-1:2.

Suitably the bristle surface of each side section may be 25-75% of the area of the bristle surface of the mid section. Suitably the bristle surface of the tip section may be 25-50% of the area of the bristle surface of the mid section.

The tip section may be resiliently flexibly connected to the mid section, and the side sections may each be resiliently flexibly connected to the mid- or tip-section by means of connections known in the art for resiliently flexibly connecting sections of toothbrush heads, e.g. as disclosed in WO-A-97/07707. A preferred connection is a composite plastic material—elastomer material connections. Suitably such a connection may comprise a thin flexible leaf of plastic material, the sections and leaf being made integrally of such a plastic material, the leaf being at least partly surrounded by the elastomer material, e.g. embedded therein.

Suitable plastics materials include known materials for toothbrush manufacture, e.g. polypropylene. Suitable elastomeric materials include known thermoplastic elastomer materials known for use in toothbrushes. Using such materials the toothbrush of the invention can easily be made by well known two-component injection moulding technology.

If the bristle surfaces of the tip and/or side sections are at an angle less than 180° to the bristle surface of the mid section, then the toothbrush head may be made by a process analogous to that disclosed in WO-A-97/07707, in which the head is first made with the bristle surfaces of the sections all coplanar, then the tip and side sections are folded to the requisite angle relative to the mid section. In this way the need for retractable pins to form the bristle insertion holes in the sections can be avoided.

The invention will now be described by way of non-limiting example only with reference to the accompanying Figures:

FIG. 1 a plan view of a toothbrush of the invention and the adjacent part of the grip handle.

Figure 1A:
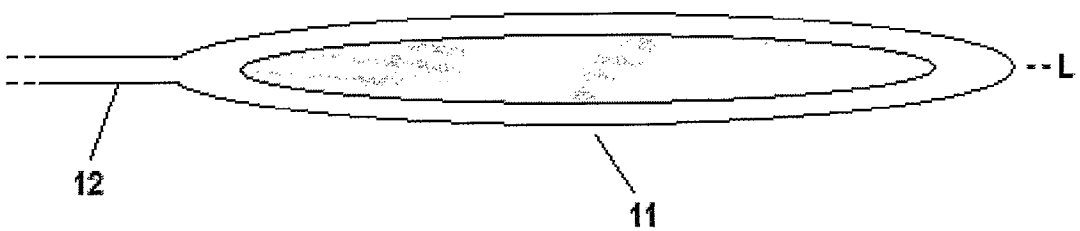

FIG. 1A is a plan view of the adjacent part of the grip handle.

Figure 2:
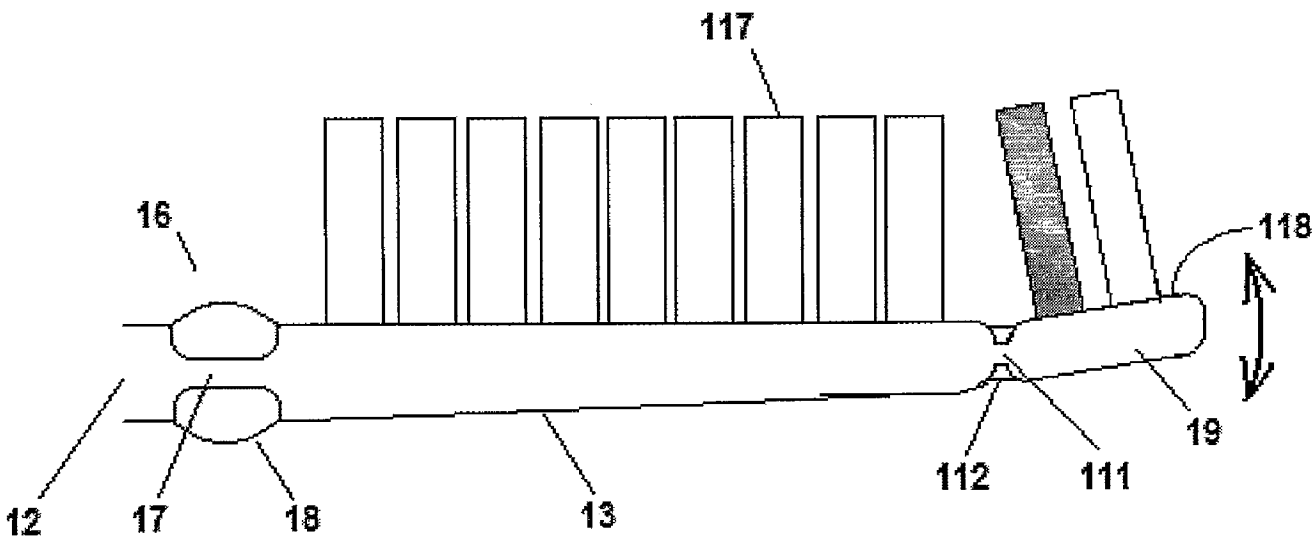

FIG. 2 a longitudinal section at line B-B of the head of FIG. 1.

Figure 3:
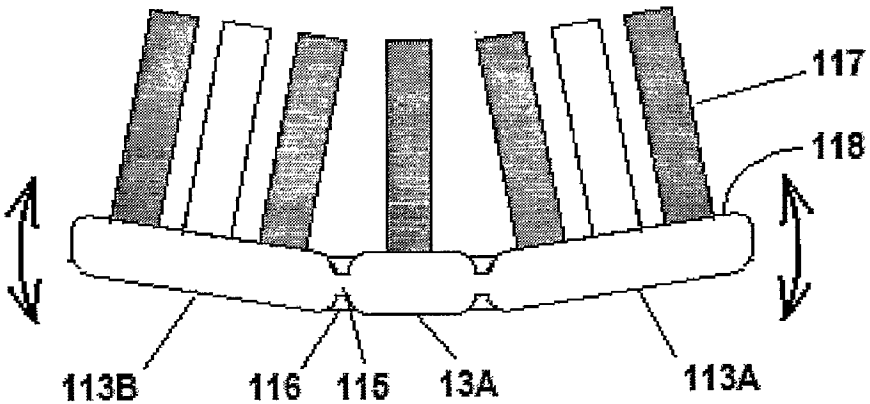

FIG. 3 a cross section at line A-A of the head of FIG. 1.

Figure 4:
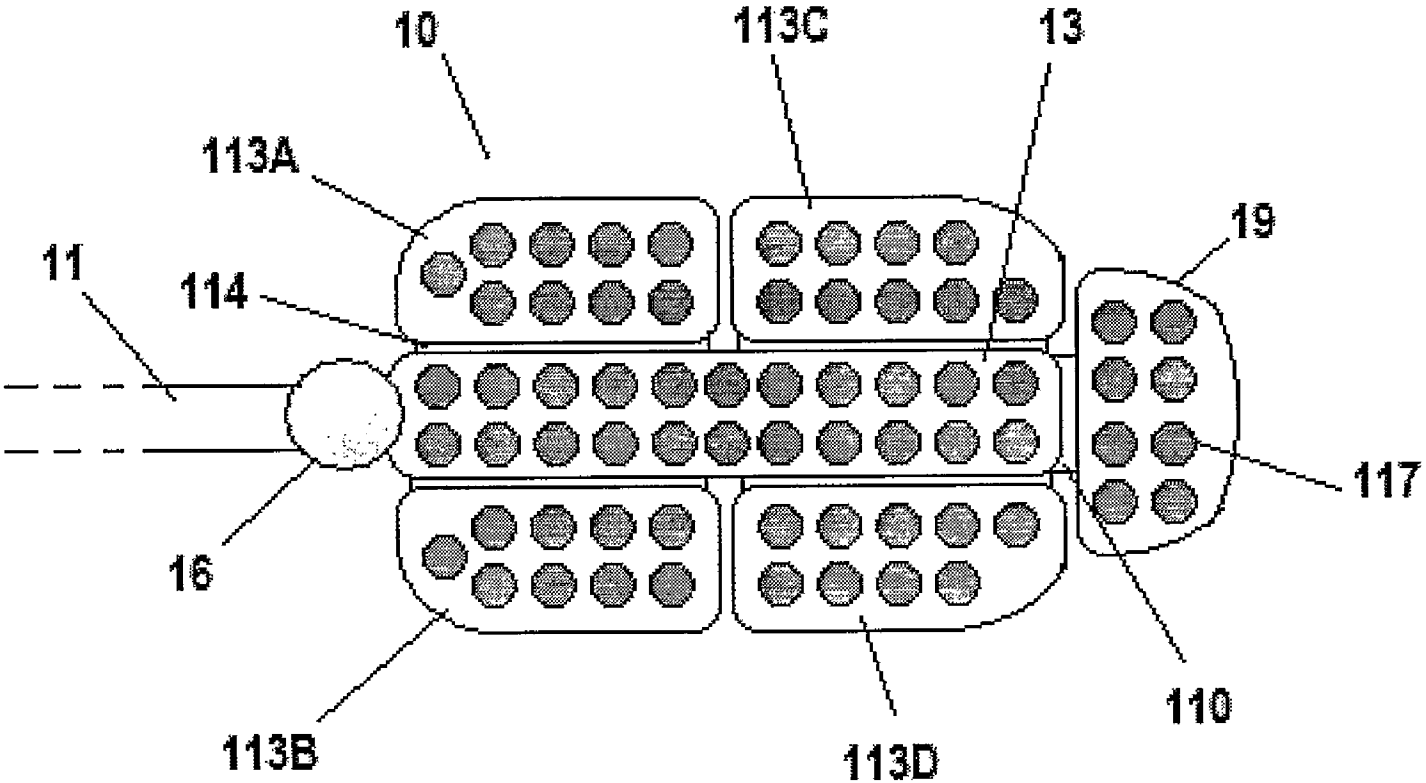

FIG. 4 a plan view of another toothbrush of the invention and the adjacent part of the grip handle.

Referring to FIG. 1, this shows a plan view of a head 10 (overall) of a toothbrush of this invention and the immediately adjacent part of the grip handle 11. The handle 11 itself is shown in plan view as FIG. 1A, at a different scale. It is seen that adjacent the head 10 the handle 11 narrows to form a neck 12. The head 10, handle 11 and neck 12 are all integrally made of polypropylene and arranged along a toothbrush longitudinal direction L-L, with a corresponding width direction W-W perpendicular to the longitudinal direction.

As can be seen from FIGS. 1-3, the toothbrush head 10 comprises a mid section 13 having a base end 14 longitudinally close to the grip handle 11, and a longitudinally opposite tip end 15 longitudinally further from the grip handle 11. The mid section 13 is resiliently flexibly connected to the grip handle 11 via a known type of resiliently flexible connection 16 comprising a thin plastics material leaf 17 enclosed in a sphere of elastomer material 18. The mid section 13 comprises a widthways narrowed region 13A adjacent its base end, with a widthways relatively wider region 13B adjacent the tip end 15.

A tip section 19 is resiliently flexibly connected to the tip end 15 of mid section 13 via a known type of resiliently flexible connection 110 comprising a thin plastics material leaf 111 enclosed in a mass of elastomer material 112. In effect the connection 110 comprises a groove in the upper and lower surfaces of the head 10 as seen in FIG. 3, with the leaf 111 at the bottom of each groove, the groove containing an elastomer material 112. Connected in this way, the tip section 19 may fold relative to the mid section 13 about a widthways oriented fold axis, i.e. in the arc as shown by the arrow in FIG. 2.

Two side sections 113A, 113B are each resiliently flexibly connected to the mid section 13 at respective points on widthways opposite sides of the narrowed part 13A of the mid section 13. The side sections 113A are resiliently flexibly connected to the mid section 13 via a known type of resiliently flexible connection 114 comprising a thin plastics material leaf 115 enclosed in a mass of elastomer material 116, in a construction analogous to the connection 110. This connection allows the side sections 113 to fold relative to the mid section 13 about a fold axis having a component oriented parallel to the longitudinal direction L-L i.e. in the arc as shown by the arrows in FIG. 3.

Referring to FIG. 4 another toothbrush head 10 of the invention is shown in plan view, parts corresponding to FIG. 1 being numbered correspondingly. However in this embodiment there are four side sections 113A-D, each connected to the mid section 13 by a flexible connection 114. The flexible connections 110, 114 each comprise a thin leaf connection of plastic material integral with the sections 13,19,113A-D, covered with an elastomer material (not shown) but of similar construction to known types of link in flexible toothbrush heads. The elastomer material (not shown) may be continued into the spaces between the sections 19,113A-113D as a continuous web of elastomer material.

Bristles arranged in conventional tufts 117 extend from the respective bristle surfaces 118 of the mid, tip and side sections 13, 19, 113. The bristle surface 118 of the tip section forms an angle less than 180°, typically 150-175°, with the bristle surface 118 of the mid section 13, as seen looking widthways as in FIG. 2. The bristle surface 118 of each of the side sections 113 form an angle less than 180°, typically 150-175°, with the bristle surface 118 of the mid section 13, as seen looking longitudinally in the sectional view of FIG. 3.

As can be seen in FIG. 1 mid section 13 extends for ca. 50-80% of the length of the head 10 as between the base end 14 and the end of the tip section 19 most longitudinally distant from the grip handle 12. The side sections 113A, 113B are located predominantly toward the base end 14 of the mid section 13, and each extend for 30-80% of the length of the mid section 13 as between the base end 14 and the end 15 of the mid section most longitudinally distant from the grip handle 12.

The invention claimed is:

1. A toothbrush head, connected to a toothbrush grip handle to define a toothbrush longitudinal direction, characterised by the toothbrush head comprising:

a mid section having a base end longitudinally close to the grip handle and a longitudinally opposite tip end longitudinally further from the grip handle, a tip section resiliently flexibly connected by a resiliently flexible connection to the mid section at the tip end thereof, the mid section extending for 50-80% of the length of the head as between the base end and the end of the tip section most longitudinally distant from the grip handle, at least two side sections each resiliently flexibly connected by a resiliently flexible connection to the mid section at respective points on widthways opposite sides of the mid section to allow the side sections to fold relative to the mid section about a fold axis parallel to the longitudinal direction or having a component oriented parallel to the longitudinal direction, the side sections each extending for 30-80% of the length of the mid section as between the base end and the end of the mid section most longitudinally distant from the grip handle, and the tip section and side sections are able to fold relative to the mid section independently of each other by means of a resiliently flexible connection being provided only between the tip section and the mid section and between each side section and the middle section.

2. A toothbrush head according to claim 1 wherein the mid section is resiliently flexibly connected to the grip handle.

3. A toothbrush head according to claim 1 or 2 wherein there are only two side sections.

4. A toothbrush head according to claim 1 wherein the side sections are resiliently flexibly connected to the mid section to allow the side sections to fold relative to the mid section about a fold axis having a component oriented parallel to the longitudinal direction.

5. A toothbrush head according to claim 1 wherein the bristle surface of the tip section forms an angle less than 180° with the bristle surface of the mid section.

6. A toothbrush head according to claim 1 wherein the bristle surface of each of the side sections form an angle less than 180° with the bristle surface of the mid section.

7. A toothbrush head according to claim 1 wherein the side sections are located predominantly toward the base end of the mid section.

8. A toothbrush head according to claim 1 wherein the mid section comprises a widthways narrowed region adjacent its base end and the side sections are connected to this narrowed region.

9. A toothbrush head according to claim 1 wherein the bristle surface of each side section is 25-75% of the area of the bristle surface of the mid section.

10. A toothbrush head according to claim 1 wherein the bristle surface of the tip section is 25-50% of the area of the bristle surface of the mid section.

11. A toothbrush head according to claim 1 having four side sections, two of said four side sections being located on each opposite side of the mid section.

* * * * *